US011306920B2

(12) United States Patent
Neal

(10) Patent No.: US 11,306,920 B2
(45) Date of Patent: Apr. 19, 2022

(54) FIRE ENCLOSURES WITH ADJUSTABLE WIND SHIELDS

(71) Applicant: Hanie Group LLC, Portland, OR (US)

(72) Inventor: Ryan Neal, Portland, OR (US)

(73) Assignee: HANIE GROUP LLC, Portland, OR (US)

( * ) Notice: Subject to any disclaimer, the term of this patent is extended or adjusted under 35 U.S.C. 154(b) by 3 days.

(21) Appl. No.: 16/880,544

(22) Filed: May 21, 2020

(65) Prior Publication Data

US 2020/0378608 A1 Dec. 3, 2020

Related U.S. Application Data

(60) Provisional application No. 62/854,805, filed on May 30, 2019.

(51) Int. Cl.
*F24B 1/00* (2006.01)
*F24B 1/192* (2006.01)
*F24B 1/198* (2006.01)

(52) U.S. Cl.
CPC ..... *F24B 1/192* (2013.01); *F24B 1/198* (2013.01)

(58) Field of Classification Search
CPC ..... F24B 1/181; F24B 1/191; F24B 1/192; F24B 1/198; F24B 3/00; A47J 36/00; A47J 37/07; A47J 37/0718; A47J 37/0763; F24C 15/36; A47G 5/04
USPC ..... 126/59, 57
See application file for complete search history.

(56) References Cited

U.S. PATENT DOCUMENTS 3,494,349 A * 2/1970 Allen ..... A47J 37/0786 126/25 B
3,809,058 A * 5/1974 Becker ..... F24B 1/181 126/547
4,108,142 A * 8/1978 Barson ..... A47J 37/0682 126/41 R
4,572,156 A * 2/1986 Lentz ..... F24B 1/192 126/548
8,360,049 B2 * 1/2013 Stephens ..... E04H 15/003 126/500
D718,082 S * 11/2014 Chung ..... D7/335
10,222,092 B1 * 3/2019 Traeger ..... F24B 3/00
(Continued)

FOREIGN PATENT DOCUMENTS

DE 3527810 A1 * 2/1987 ..... F24B 1/192

OTHER PUBLICATIONS

Machine Translation of Pickhan, (Year: 1987).*

*Primary Examiner* — Steven B McAllister
*Assistant Examiner* — Mark P Yost
(74) *Attorney, Agent, or Firm* — McClure, Qualey & Rodack, LLP

(57) ABSTRACT

A representative enclosure includes: a base defining an interior configured to receive combustible materials, the base having an aperture defining an opening, which communicates with the interior, the opening being configured to receive therethrough the combustible materials; a spark screen configured to prevent access to the interior via the opening when in a closed position in which the spark screen engages the base, the spark screen being further configured to permit a flow of air into and out of the interior; and a wind shield, mounted to the base, having a shield portion extending upwardly from the base and disposed exterior to the spark screen, the shield portion being movable relative to the base.

12 Claims, 4 Drawing Sheets

(56) References Cited

U.S. PATENT DOCUMENTS

| | | | | |
|---|---|---|---|---|
| 2004/0255930 | A1* | 12/2004 | Klemming | F24B 1/182<br>126/506 |
| 2006/0236996 | A1* | 10/2006 | Mosher, II | F24C 3/14<br>126/30 |
| 2008/0163863 | A1* | 7/2008 | Thomas | F24C 15/22<br>126/512 |
| 2011/0100351 | A1* | 5/2011 | Dupuie | A45F 5/00<br>126/25 R |

* cited by examiner

FIRE ENCLOSURES WITH ADJUSTABLE WIND SHIELDS

CROSS REFERENCE TO RELATED APPLICATION

This utility application claims the benefit of and priority to U.S. Provisional Application 62/854,805, filed on 30 May 2019, which is incorporated herein by reference in its entirety.

BACKGROUND

Technical Field

The disclosure generally relates to structures for facilitating outdoor fires.

Description of the Related Art

Traditionally, outdoor fires have been formed using locally-available materials, not only for combustion, but also for containment. By way of example, rocks available at a campsite are often used to form a perimeter around an outdoor fire to provide containment for a fire fueled by branches and logs.

Recently, outdoor fires for use in more residential settings have become popular. To meet these desires, various forms of fabricated structures known as "fire pits" have become available. Although meeting with a certain degree of success for their intended uses, these structures tend to be ill-suited for some applications. By way of example, these structures often lack an ability to shield the contained fires from wind.

Therefore, it is desirable to provide a device that addresses the aforementioned, perceived needs.

SUMMARY

Various embodiments of enclosures for containing combustible materials of a fire are provided. In this regard, an example embodiment of an enclosure comprises: a base defining an interior configured to receive combustible materials, the base having an aperture defining an opening, which communicates with the interior, the opening being configured to receive therethrough the combustible materials; a spark screen configured to prevent access to the interior via the opening when in a closed position in which the spark screen engages the base, the spark screen being further configured to permit a flow of air into and out of the interior; and a wind shield, mounted to the base, having a shield portion extending upwardly from the base and disposed exterior to the spark screen, the shield portion being movable relative to the base.

In some embodiments, the enclosure further comprises an annular flange mounted to the base, the interior of the base being disposed within a central zone defined by the annular flange; and the wind shield has a mounting portion, disposed below the shield portion, configured to engage the annular flange when the wind shield is in a mounted position.

In some embodiments, the mounting portion of the wind shield has an annular segment disposed in an overlying relationship with the annular flange when the wind shield is in the mounted position.

In some embodiments, the mounting portion of the wind shield has a bearing surface configured to contact an upper surface of the annular flange when the wind shield is in the mounted position.

In some embodiments, the bearing surface is a surface of roller bearing.

In some embodiments, the annular flange extends outwardly from the aperture.

In some embodiments, the enclosure further comprises an annular channel disposed about the interior; and the wind shield has a mounting portion, disposed below the shield portion, configured to extend into the annular channel.

In some embodiments, the annular channel is an upwardly opening channel; and the mounting portion has a downwardly extending wall segment configured to extend into the annular channel.

In some embodiments, the annular channel is defined by a sidewall of the base, which defines the interior, and an outer channel sidewall disposed outboard of the sidewall of the base.

In some embodiments, the annular channel is defined by a sidewall of the base, which defines the interior, and an inner channel sidewall disposed inboard of the sidewall of the base.

In some embodiments, the wind shield is configured to rotate about a central axis of the interior.

In some embodiments, the wind shield spans an angle of at least approximately 90 degrees about a central axis of the base.

In some embodiments, the wind shield spans at least approximately 180 degrees.

In some embodiments, the wind shield spans less than approximately 270 degrees.

In some embodiments, the wind shield extends to a maximum height higher than a maximum height of the spark screen.

In some embodiments, the shield portion of the wind shield is configured as a continuous sheet of material.

Other objects, features, and/or advantages will become apparent from the following detailed description of the preferred but non-limiting embodiments. The following description is made with reference to the accompanying drawings.

DETAILED DESCRIPTION

For ease in explanation, the following describes several embodiments of a fire enclosure. It is to be understood that the invention is not limited in its application to the details of the particular arrangements shown since the invention is capable of other embodiments. Also, the terminology used herein is for the purpose of description and not of limitation.

In this regard, various enclosures for containing combustible materials of a fire are provided. In some embodiments, the enclosure incorporates a wind shield that mounts to a base and which extends upwardly from the base to shield a fire from wind. Advantageously, the wind shield is movable relative to the base and, thus, may be dynamically repositioned to accommodate changes in wind direction.

Figure 1A:
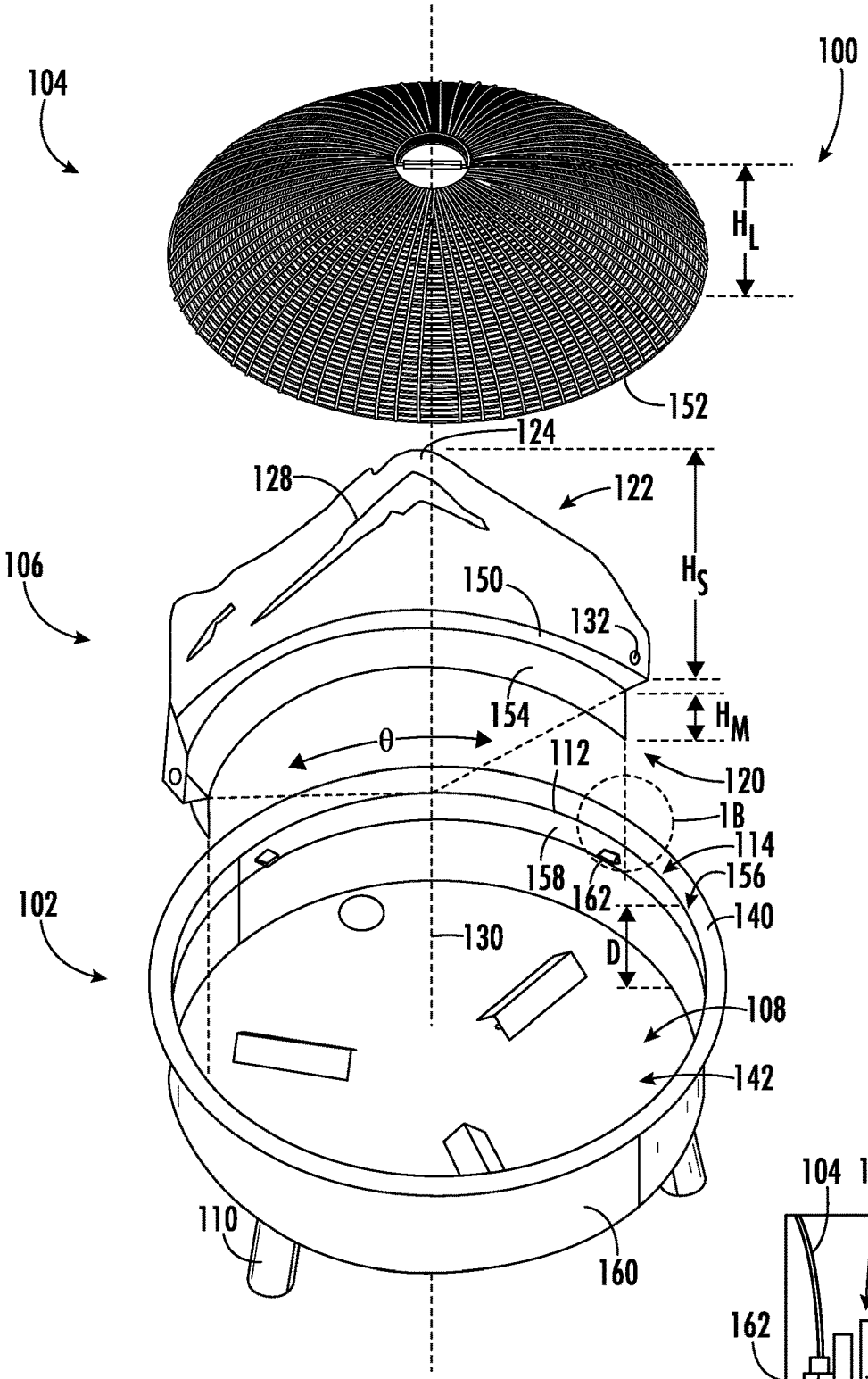
FIG. 1A is a partially-exploded, schematic view of an embodiment of an enclosure.
Figure 1B:
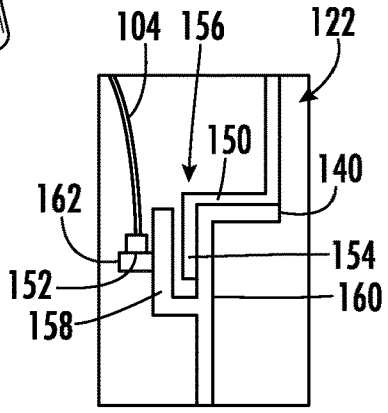
FIG. 1B is a schematic, cross-sectional view of a portion of the embodiment of FIG. 1A.

FIGS. 1A-3 depict an example embodiment of an enclosure 100. As shown in FIG. 1A, enclosure 100 incorporates a base 102, a spark screen 104 and a wind shield 106. Base 102 defines an interior 108 that is configured to receive combustible materials. Interior 108 exhibits a depth (D) of between approximately 2 and 12 inches, preferably between approximately 8 and 12 inches. In this embodiment, interior 108 is circular (in plan view) although various other shapes may be used.

Base 102, in addition to incorporating one or more optional legs (e.g., leg 110) for support, includes an aperture 112 that defines an opening 114. Opening 114 communicates with interior 108 and is configured so that combustible materials may be passed through the opening and into interior 108 for forming a fire.

Figure 2:
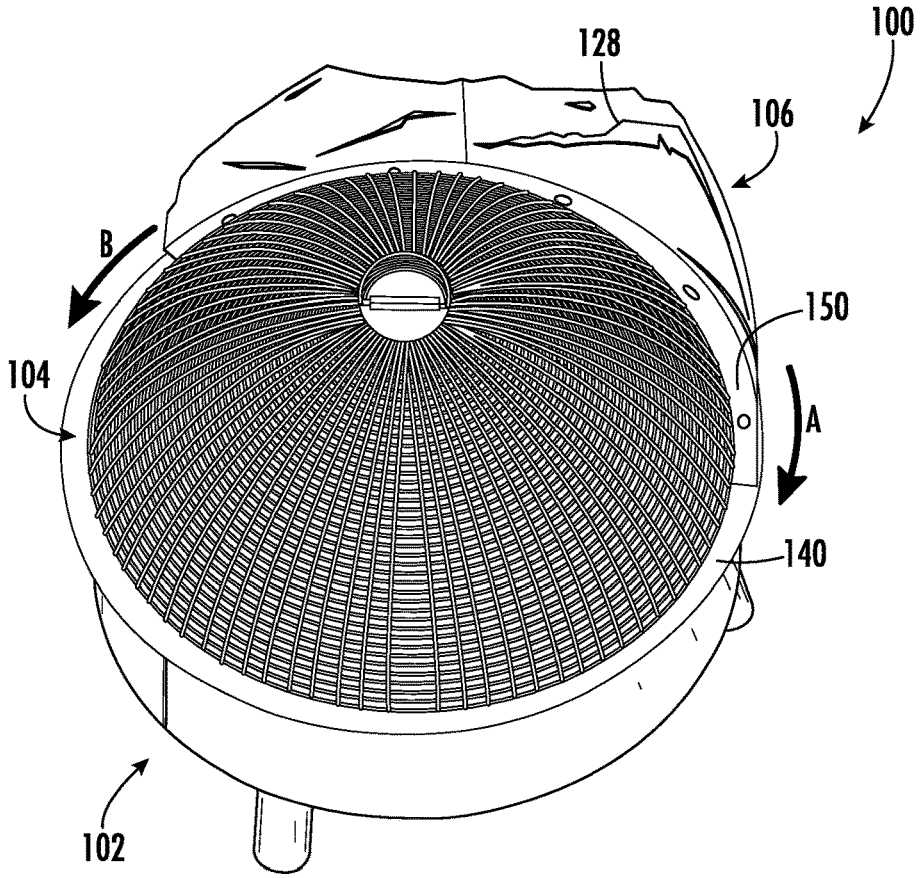
FIG. 2 is a schematic, front perspective view of the embodiment of FIG. 1A.

Spark screen 104 of this embodiment is a removable spark screen that is configured to prevent access to interior 108 via opening 114 when spark screen 104 is in a closed position (FIG. 2). In the closed position, spark screen 104 engages base 102 about a perimeter of opening 114 to close the opening. Owing to the structure of spark screen 104, air is permitted to flow through spark screen 104 and, thus, into and out of interior 108 even when spark screen 104 is in the closed position. In some embodiments, spark screen 104 incorporates a mesh structure to provide such functionality. Additionally, in some embodiments, spark screen 104 exhibits a maximum height (HO) of between approximately 0 and 12 inches, preferably between approximately 6 and 12 inches.

Wind shield 106 is mounted to base 102 and preferably is removable. Wind shield 106 includes a mounting portion 120, which facilitates mounting of wind shield 106 to base 102, and a shield portion 122, which is disposed exterior to spark screen 104 when the spark screen is in the closed position. Shield portion 122 extends upwardly from mounting portion 120 to protrude above base 102. Shield portion 122 exhibits a maximum height (Hs) of between approximately 1 and 12 inches, preferably between approximately 3 and 12 inches. In some embodiments, only a portion of shield portion 112 exhibits the maximum height (Hs), such as in this embodiment in which Hs is exhibited at a peak 124 of the wind shield. Notably, in some embodiments, maximum height (Hs) of shield portion 122 is higher than the maximum height (HO) of spark screen 104.

Shield portion 112 also spans an angle (θ) about central axis 130. In some embodiments, the angle (θ) spanned by shield portion 112 is between approximately 10 and 280 degrees, preferably between approximately 120 and 180 degrees.

Figure 3:
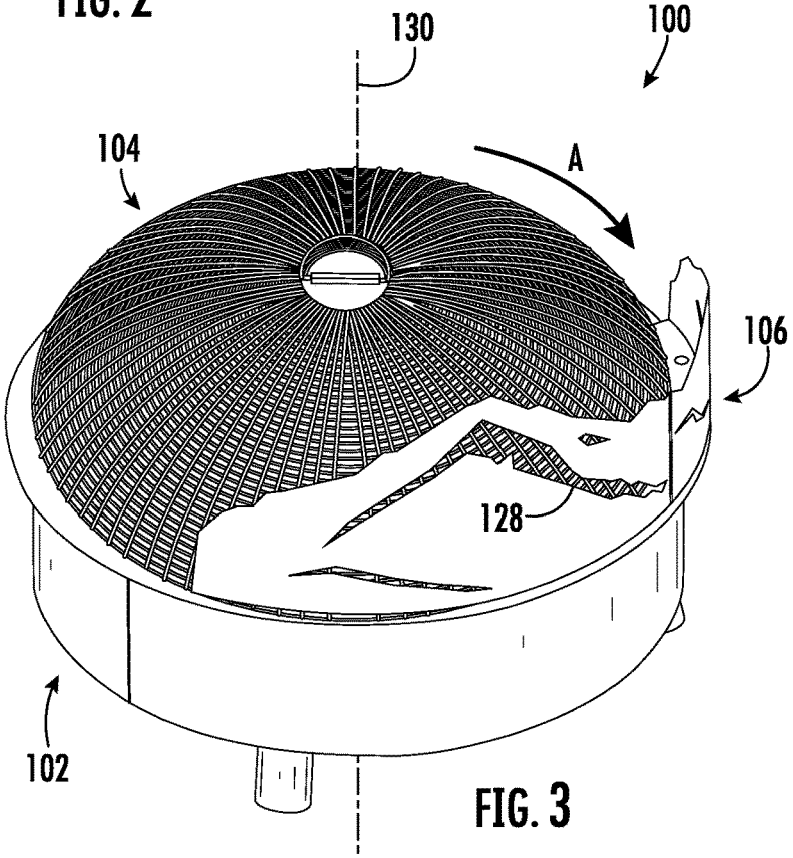
FIG. 3 is a schematic view of the embodiment of FIGS. 1A, 1B and 2 with the wind shield repositioned from that shown in FIG. 2.

In some embodiments, removability of wind shield 106 may facilitate use of an enclosure without the wind shield and/or interchangeability of wind shields of various designs based on the desire of the user. By way of example, wind shield 106 shown in FIGS. 1A, 2 and 3 is representative of a mountain vista owing to exterior shaping and the incorporation of one or more viewing apertures (e.g., viewing aperture 128) that are configured for light to emit therethrough. In other embodiments, other exterior shapes and/or other numbers, sizes and/or shapes of viewing apertures may be provided with a wind shield so that the experience provided by the enclosure may be altered. Additionally, in some embodiments, one or more apertures may be provided to facilitate moving of wind shield 106. By way of example, a tool aperture 132 is provided at an end of shield portion 122 to facilitate engagement with a fire poker (not shown).

As shown with reference to FIGS. 2 and 3, at least shield portion 122 of wind shield 106 is movable from a first position (FIG. 2) to a second position (FIG. 3) as indicated by arrow A, which depicts clockwise movement or rotation of shield portion 122 about central axis 130. Note also that at least shield portion 122 of wind shield 106 is movable both clockwise and counter-clockwise relative to base 102 as indicated by arrows A and B, respectively.

Referring back to FIG. 1A, it is shown that enclosure 100 incorporates an annular flange 140 that is mounted to base 102. In this embodiment, annular flange 140 extends radially outwardly from an uppermost portion of base 102, which is co-located with aperture 112. So configured, interior 108 is disposed within a central zone 142 defined by annular flange 140.

Mounting portion 120 of wind shield 106 engages annular flange 140 when in the mounted position (FIGS. 2 and 3). In particular, mounting portion 120 incorporates an annular segment 150 (see, FIGS. 1A and 1B) that is disposed in an overlying relationship with annular flange 140 when wind shield 106 is in the mounted position. Note that, in this embodiment, a lower edge 152 of spark screen 104 contacts base 102 at a position lower (relative to central axis 130) than shield portion 122 and annular segment 150. That is, the lower edge 152 of spark screen 104 nests inboard of wind shield 106 when in the closed position.

Mounting portion 120 also incorporates a wall segment 154 that extends downwardly from annular segment 150. Wall segment 154 is configured to engage base 102 to prevent wind shield 106 from dislodging or falling from the mounted position even during repositioning. In this embodiment, wall segment 154 engages within an upwardly-opening annular channel 156 defined between an inner channel sidewall 158 and a sidewall 160 of the base. Wall segment 154 exhibits a maximum height ($H_M$) of between approximately 0.5 and 3 inches, preferably between approximately 1 and 2 inches. Note also that in this embodiment, nesting of spark screen 104 is facilitated by mounting posts (e.g., mounting post 162) that extends inwardly from inner channel sidewall 158.

Figure 4A:
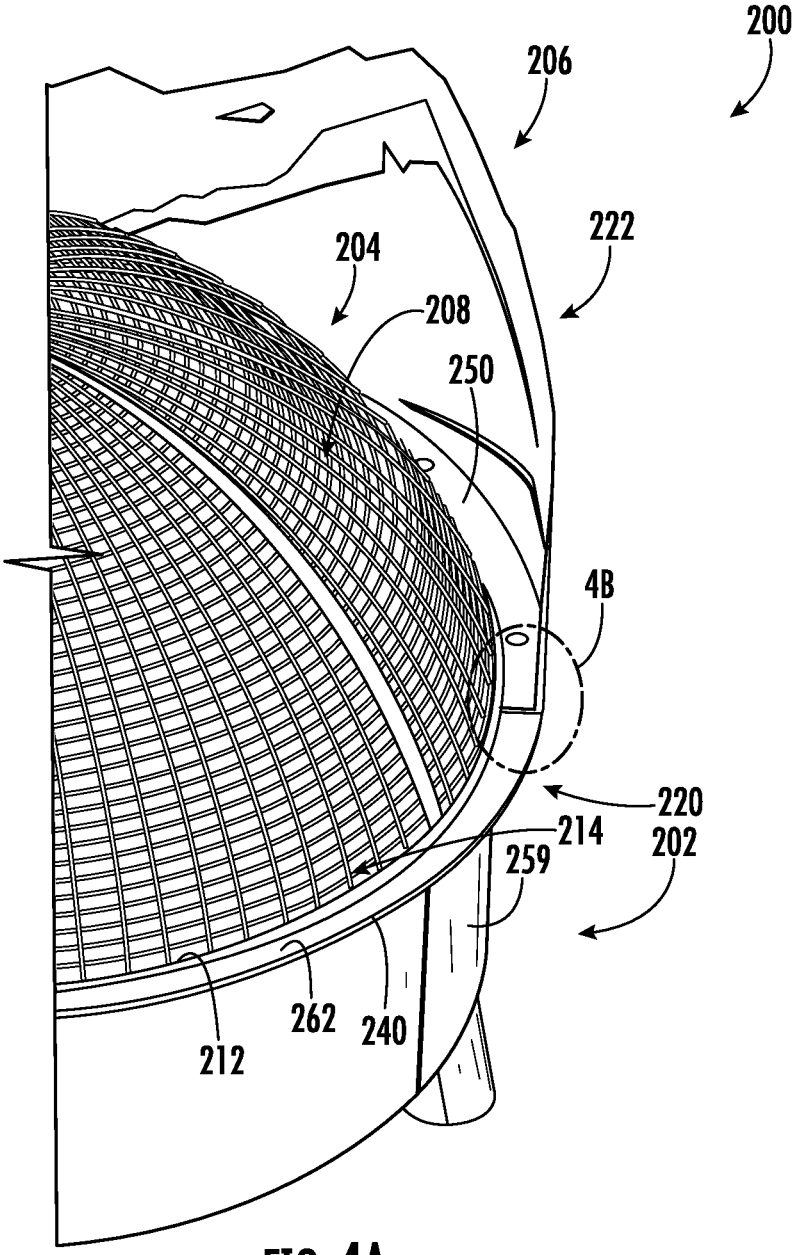
FIG. 4A is a partially-cutaway, schematic view of another embodiment of an enclosure showing mounting detail of the wind shield.
Figure 4B:
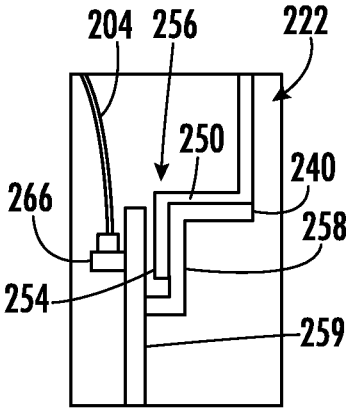
FIG. 4B is a schematic, cross-sectional view of a portion of the embodiment of FIG. 4A.
Figure 5:
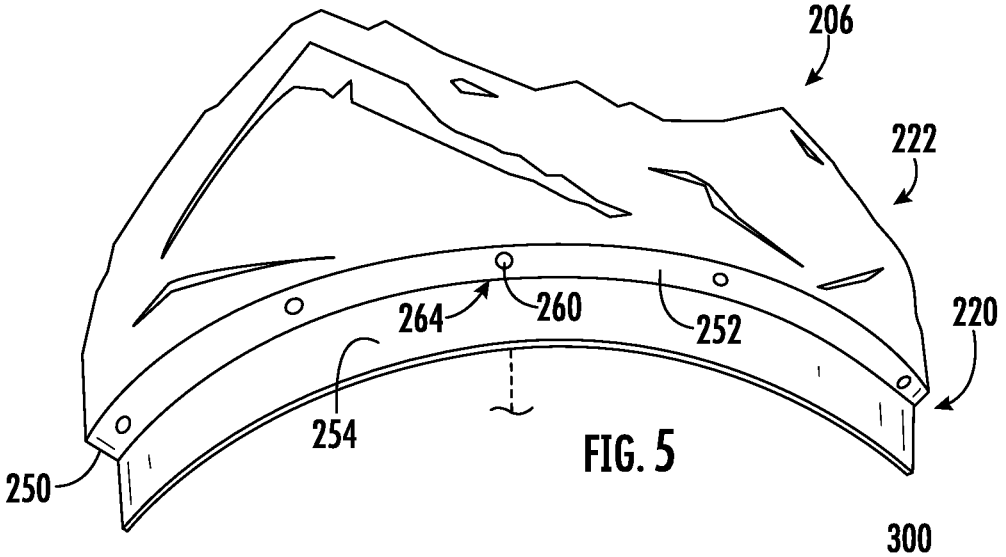
FIG. 5 is a schematic perspective view showing the underside of the wind shield of FIGS. 4A and 4B.

Another embodiment of an enclosure is depicted in FIGS. 4A, 4B and 5. As shown in FIG. 4A, enclosure 200 incorporates a base 202, a spark screen 204 and a wind shield 206. Base 202 defines an interior 208 that is configured to receive combustible materials. Base 202 also includes an aperture 212 that defines an opening 214. Spark screen 204 is configured to prevent access to interior 208 via opening 214 when in a closed position.

Wind shield 206 is removably mounted to base 202 and incorporates a mounting portion 220, which facilitates mounting of wind shield 206 to base 202, and a shield portion 222, which is disposed exterior to spark screen 204 when the spark screen is in the closed position. Shield portion 222 extends upwardly from mounting portion 220 to protrude above base 202.

As shown in FIGS. 4A and 4B, enclosure 200 incorporates an annular flange 240 that is mounted to base 202. Mounting portion 220 of wind shield 206 engages annular flange 240 when in the mounted position. In this regard, mounting portion 220 incorporates an annular segment 250 that is disposed in an overlying relationship with annular flange 240 when wind shield 206 is in the mounted position. Specifically, an underside 252 of annular segment 250 includes a bearing surface 260 that is configured to contact an upper surface 262 of annular flange 240. In some embodiments, the bearing surface includes the corresponding surfaces of one or more roller bearings (for example, roller bearing 264 of FIG. 5).

Mounting portion 220 also incorporates a wall segment 254 that extends downwardly from annular segment 250. Wall segment 254 is configured to engage base 202 to prevent wind shield 206 from dislodging or falling from the mounted position even during repositioning. In this embodiment, wall segment 254 engages within an upwardly-opening annular channel 256 defined between an outer channel sidewall 258 and a sidewall 259 of the base. Additionally, nesting of spark screen 204 is facilitated by mounting posts (e.g., mounting post 266) that extends inwardly from sidewall 206. It should be noted that in comparison with the embodiment of FIG. 1, given similar dimensions of the respective bases, spark screen 204 of the embodiment of FIG. 4 may be of a larger diameter since being able to fill the entire circumference of the base owing to the wind screen being mounted outboard of the sidewall of the base.

Figure 6:
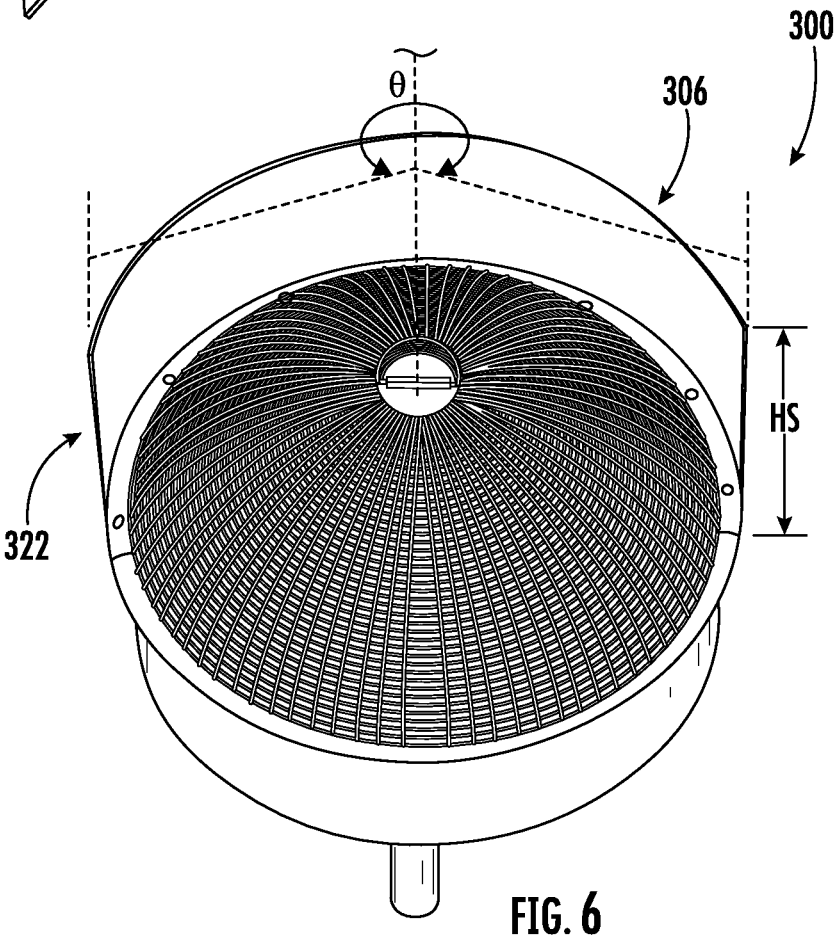
FIG. 6 is a schematic view of another embodiment of an enclosure.

FIG. 6 depicts another embodiment of an enclosure. In particular, enclosure 300 incorporates a wind shield 306 that is configured as a continuous sheet of material (e.g., the wind shield lacks viewing apertures). In contrast to previously described embodiments that exhibit a maximum height (Hs) at a peak, shield portion 322 exhibits a substantially consistent height along its length. Additionally, shield portion 322 spans an angle (θ) over more than approximately 180 degrees.

The embodiments described above are illustrative of the invention and it will be appreciated that various permutations of these embodiments may be implemented consistent with the scope and spirit of the invention.

I claim:

1. An enclosure for containing combustible materials of a fire, the enclosure comprising:

a base defining an interior configured to receive combustible materials, the base having an aperture defining an opening, which communicates with the interior, the opening being configured to receive therethrough the combustible materials, the base defining an upwardly opening annular channel disposed about the interior;

an annular flange mounted to the base, the interior of the base being disposed within a central zone defined by the annular flange;

a spark screen configured to prevent access to the interior via the opening when in a closed position in which the spark screen engages the base at positions interior of the annular channel, the spark screen being further configured to permit a flow of air into and out of the interior; and a wind shield, removably mounted to the base, having a shield portion extending upwardly from the base and disposed exterior to the spark screen, the shield portion being movable relative to the base, the wind shield further having a mounting portion, disposed below the shield portion, the mounting portion having an annular segment, disposed in an overlying relationship with the annular flange when the wind shield is in the mounted position, and a wall segment, downwardly extending from the annular segment, configured to extend into the annular channel.

2. The enclosure of claim 1, wherein the mounting portion of the wind shield has a bearing surface configured to contact an upper surface of the annular flange when the wind shield is in the mounted position.

3. The enclosure of claim 2, wherein the bearing surface is a surface of roller bearing.

4. The enclosure of claim 1, wherein the annular flange extends outwardly from the interior.

5. The enclosure of claim 1, wherein the annular channel is defined by a sidewall of the base, which defines the interior, and an outer channel sidewall disposed outboard of the sidewall of the base.

6. The enclosure of claim 1, wherein the annular channel is defined by a sidewall of the base, which defines the interior, and an inner channel sidewall disposed inboard of the sidewall of the base.

7. The enclosure of claim 1, wherein the wind shield is configured to rotate about a central axis of the interior.

8. The enclosure of claim 1, wherein the wind shield spans an angle of at least 90 degrees about a central axis of the base.

9. The enclosure of claim 8, wherein the wind shield spans at least 180 degrees.

10. The enclosure of claim 9, wherein the wind shield spans less than 270 degrees.

11. The enclosure of claim 1, wherein the wind shield extends to a maximum height higher than a maximum height of the spark screen.

12. The enclosure of claim 1, wherein the shield portion of the wind shield is configured as a continuous sheet of material.

* * * * *